US007051390B2

(12) United States Patent
van Beek

(10) Patent No.: US 7,051,390 B2
(45) Date of Patent: May 30, 2006

(54) MULTI-PURPOSE TOOL

(76) Inventor: Gys van Beek, 618 N. Georgia Ave., Caldwell, ID (US) 83605

( * ) Notice: Subject to any disclaimer, the term of this patent is extended or adjusted under 35 U.S.C. 154(b) by 0 days.

(21) Appl. No.: 11/009,556

(22) Filed: Dec. 9, 2004

(65) Prior Publication Data

US 2005/0172415 A1 Aug. 11, 2005

Related U.S. Application Data

(60) Provisional application No. 60/544,094, filed on Feb. 11, 2004.

(51) Int. Cl.
*B25D 1/00* (2006.01)

(52) U.S. Cl. ..... 7/145; 7/146

(58) Field of Classification Search ..... 7/145, 7/146, 147; 81/26

See application file for complete search history.

(56) References Cited

U.S. PATENT DOCUMENTS

| | | | | | |
|---|---|---|---|---|---|
| 110,199 | A | * | 12/1870 | Calef | 7/145 |
| 591,689 | A | * | 10/1897 | Ponkney | 7/117 |
| 604,830 | A | * | 5/1898 | Karner | 7/145 |
| 651,398 | A | * | 6/1900 | Sullivan | 7/131 |
| 855,741 | A | * | 6/1907 | Albert | 140/121 |
| 926,496 | A | * | 6/1909 | Kahl et al. | 7/130 |
| 984,858 | A | * | 2/1911 | Pearson | 198/328 |
| 4,030,150 | A | | 6/1977 | Fisher | 7/15 |
| 4,308,628 | A | | 1/1982 | Kunberger et al. | 7/145 |
| 4,727,609 | A | | 3/1988 | Smith, Jr. | 7/145 |
| 5,103,520 | A | | 4/1992 | Mazzo | 7/104 |
| D329,366 | S | | 9/1992 | Ragoonath | D8/76 |
| 5,315,725 | A | | 5/1994 | Vanden Heuvel | 7/145 |
| 5,709,031 | A | * | 1/1998 | Van Beek | 30/308.1 |

* cited by examiner

*Primary Examiner*—David B. Thomas
*Assistant Examiner*—Robert Scruggs
(74) *Attorney, Agent, or Firm*—Pedersen & Co., PLLC; Ken J. Pedersen; Barbara S. Pedersen

(57) ABSTRACT

A multipurpose tool is designed to meet the particular needs of commercial truck drivers. Preferably, it has a unitary, single-piece head which includes a chopping tool, a hammering tool, and a prying-pivoting tool, and a nail and/or staple removal assembly. Preferably, there are no sharp edges that are capable of cutting a person's skin. There are multiple surfaces and edges that may be easily wedged underneath an object to pry, lift, or force the object either in a proximal direction toward the user or in a distal direction away from the user, or upwards off a floor or truck bed. It may perform a multitude of functions, such as removing objects embedded in tires, tightening tire chains, repairing pallets (with a hammer/nail remover), moving pallets, prying open frozen doors, chopping ice (for example, removing ice build-up on vehicle). The head of the tool is slightly tilted to facilitate use as a lever. Other users, such as ranchers or farmers, will find the tool useful for repairing wire fences, stretching wire, pulling staples, and performing other small repairs.

16 Claims, 6 Drawing Sheets

MULTI-PURPOSE TOOL

This application claims priority of Provisional Application Ser. No. 60/544,094, filed Feb. 11, 2004, and entitled "Multi-Purpose Tool", which is hereby incorporated by reference.

BACKGROUND OF THE INVENTION

1. Field of the Invention

This invention relates generally to multi-purpose tools, and more particularly to a rugged multi-purpose tool meeting the unique demands of commercial truck drivers.

2. Background of the Invention

Long-haul, commercial truck drivers face a variety of unique challenges in their daily work. For example, during winter, weather truck doors may be sealed shut by ice and/or snow, preventing loading or unloading of cargo. Also, tire chains may be required for icy or snowy conditions, which in turn requires tightening and retightening the chains. Pallets loaded with cargo require repositioning, usually by levering them up and sliding them towards or away from the operator. Pallets may also become broken and need to be dismantled and/or repaired. Objects, such as small stones, may become lodged in tire treads and require removal. While existing single-purpose tools address each of these needs individually with varying effectiveness, no existing multi-purpose tool is able to perform all these and other necessary functions met by the invented tool. Furthermore, many multi-function tools have numerous moving parts and/or attachments that are vulnerable to being broken and/or lost.

Various multi-purpose tools have been developed. For example, Fisher (U.S. Pat. No. 4,030,150) discloses a combination hand tool that includes a hatchet, hammer, knife, and saw or dressing tool with a non-slip grip. These different tools are included in the form of interchangeable tool attachments, only one of which is attached to the tool at any given moment.

Mazzo (U.S. Pat. No. 5,103,520) discloses a multi-purpose hand tool that functions as a hammer/pick, probe/ruler, knife/saw, spade/trowel, and bottle opener. The various tool pieces fold into and out of operational position.

Neither of these tools, or other prior art devices, meets all the needs of commercial truck drivers. Thus, there is still a need for a rugged and durable multi-purpose tool able to perform all these and other necessary functions.

SUMMARY OF THE INVENTION

The present invention comprises a multitude of tools in a single device. The invented multi-purpose tool comprises two members: a cutting/chopping member and a hammer member, which are primarily adapted for impacting or pushing on objects or materials. The chopping member and the hammer member are positioned relative to each other and shaped to provide an especially-effective combination with great versatility. Preferably, the multi-purpose tool also includes other members or tool surfaces, in or adjacent to the chopping and hammer members, which are adapted for pulling, grasping, twisting, or manipulating an object rather than impacting an object. These other members or tool surfaces may comprise a nail remover, a prying tool, and/or a nail/staple remover, for example. Further, the entire multi-purpose tool is adapted so that it may be used effectively as a lever or prying tool.

An object of the invention is to provide a combination tool that is useful for many tasks, preferably without being extremely sharp and dangerous. It is particularly designed for the needs of long-haul, commercial truck drivers, but is useful in a variety of fields. Truck drivers face a variety of challenges due to weather and the vagaries of their work. For example, cold and/or snowy weather may cause ice build-up on doors, such as the cargo door, or over the radiator—especially overnight when the truck is parked outdoors. This ice must be removed by chopping or knocking it off. Also, the cargo trailer door may freeze shut, making it necessary to force it loose with a lever or pry bar. Palettes loaded with cargo may require moving prior to unloading or to make room for additional cargo. Lifting an edge of a palette facilitates sliding the palette by reducing frictional resistance. Palettes are also frequently damaged during use requiring repair or dismantling for disposal. Objects, such as rocks, often become lodged in tire treads and need to be removed. To meet all of these needs, the preferred multi-purpose tool preferably includes an axe-type blade for chopping ice, a combination hammer and nail remover, a pry-tool, a combination nail and staple remover, and a hanger hole for storage. Other users, such as ranchers or farmers, will find the preferred multi-purpose tool useful for repairing wire fences, stretching wire, pulling staples, and other small repairs. The preferred embodiment has no moving parts, which are more easily broken, or attaching/detaching parts, which are eventually lost.

The preferred multi-purpose tool comprises a co-planar chopping blade and a claw-style hammer member extending from opposite sides of the distal end of the handle, and a plurality of prying, grasping, or twisting tools at the distal extremity of the blade. The perimeter edges between adjacent tools are curved or otherwise shaped to allow adjacent tools to be used in combination, for example, for prying or pulling on an item with one of the tools while pivoting the tool around an adjacent tool. Specifically, the hammer and a hook member are spaced apart so that the hammer may be rested on a surface, and the hook member may pull on an object while the tool is pivoted around the hammer.

DETAILED DESCRIPTION OF THE PREFERRED EMBODIMENT

Figure 1:
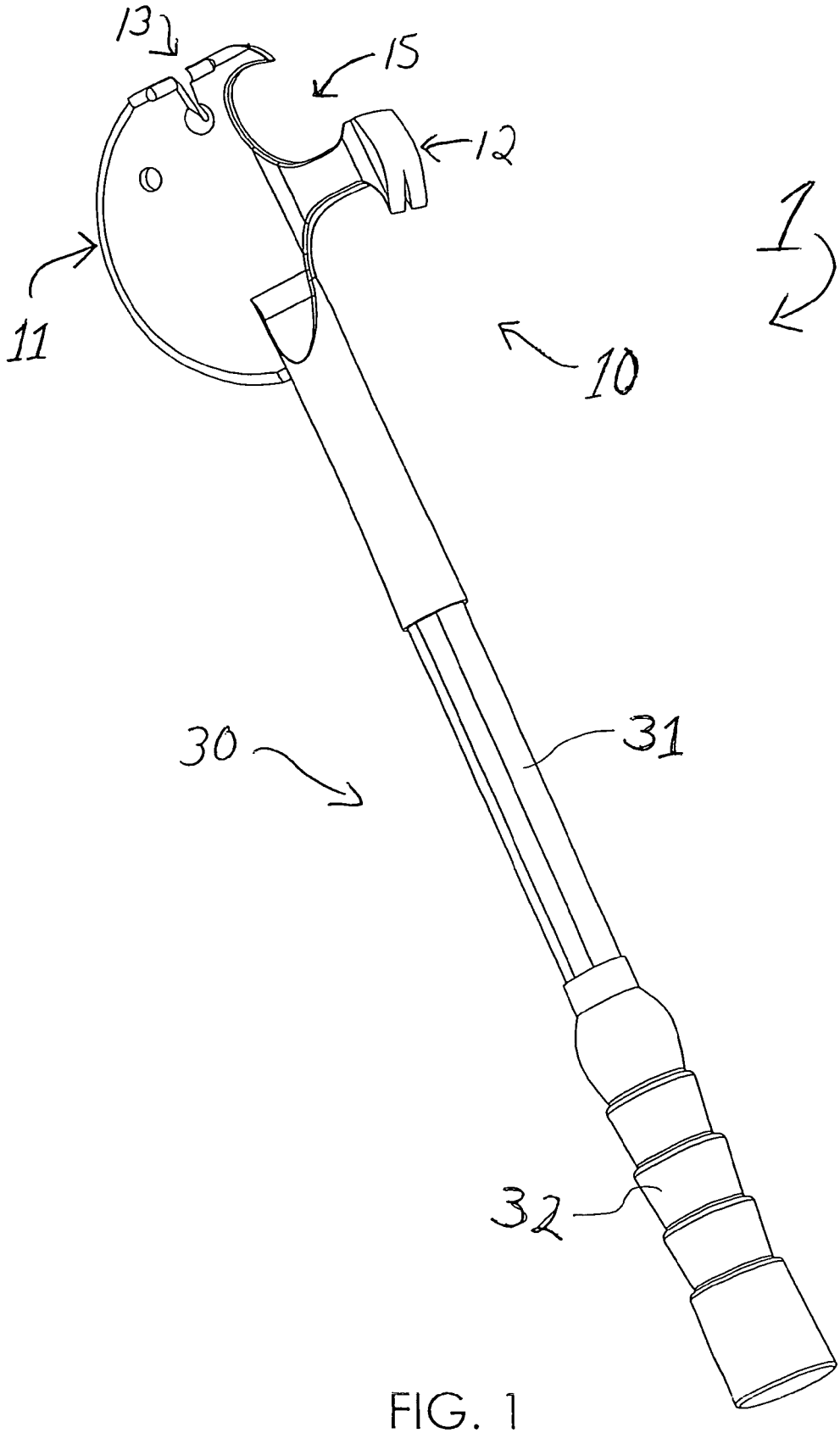
FIG. 1 is a first side perspective view of one embodiment of a multi-purpose tool.
Figure 2:
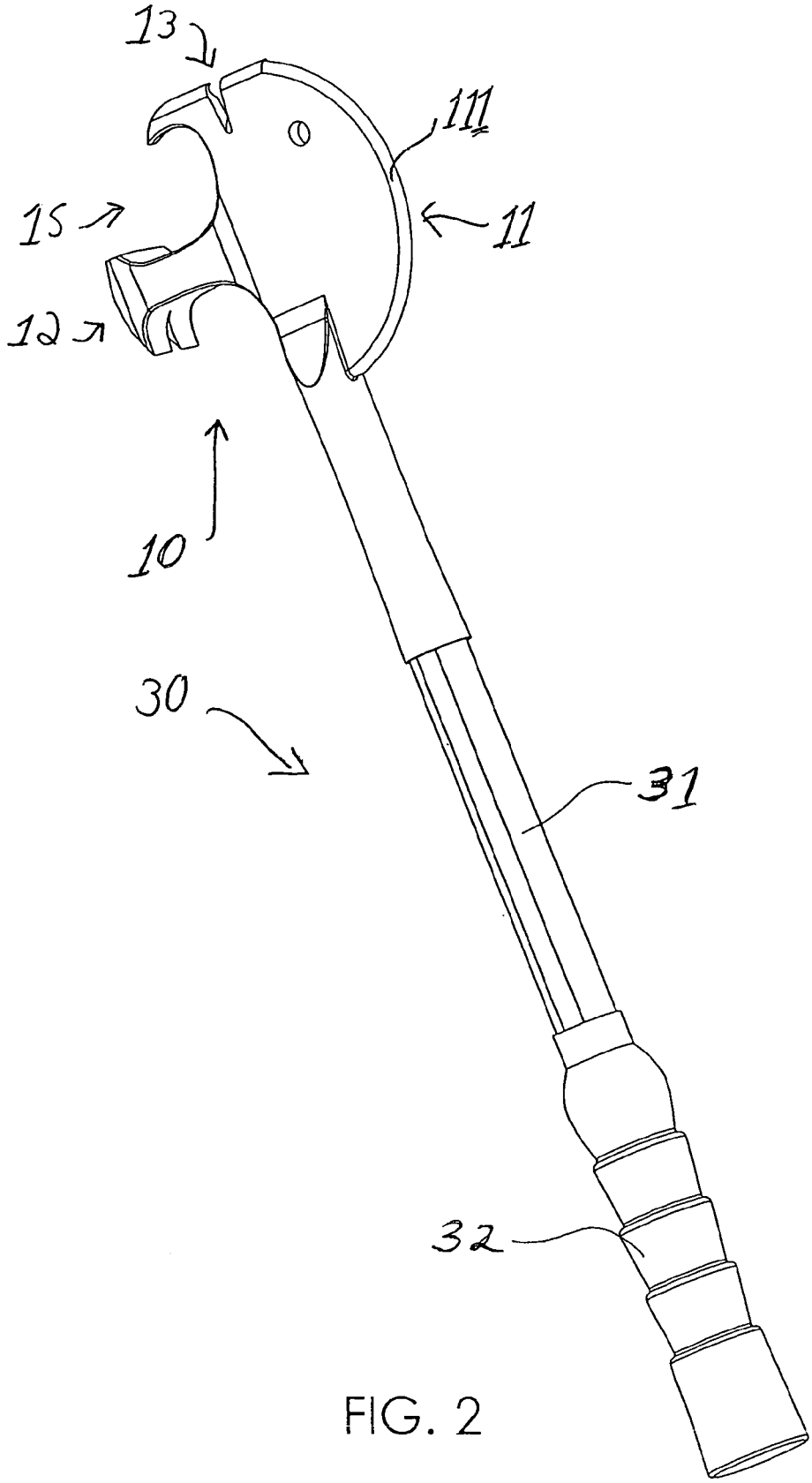
FIG. 2 is a second side perspective view of the embodiment of FIG. 1.
Figures 3, 4:
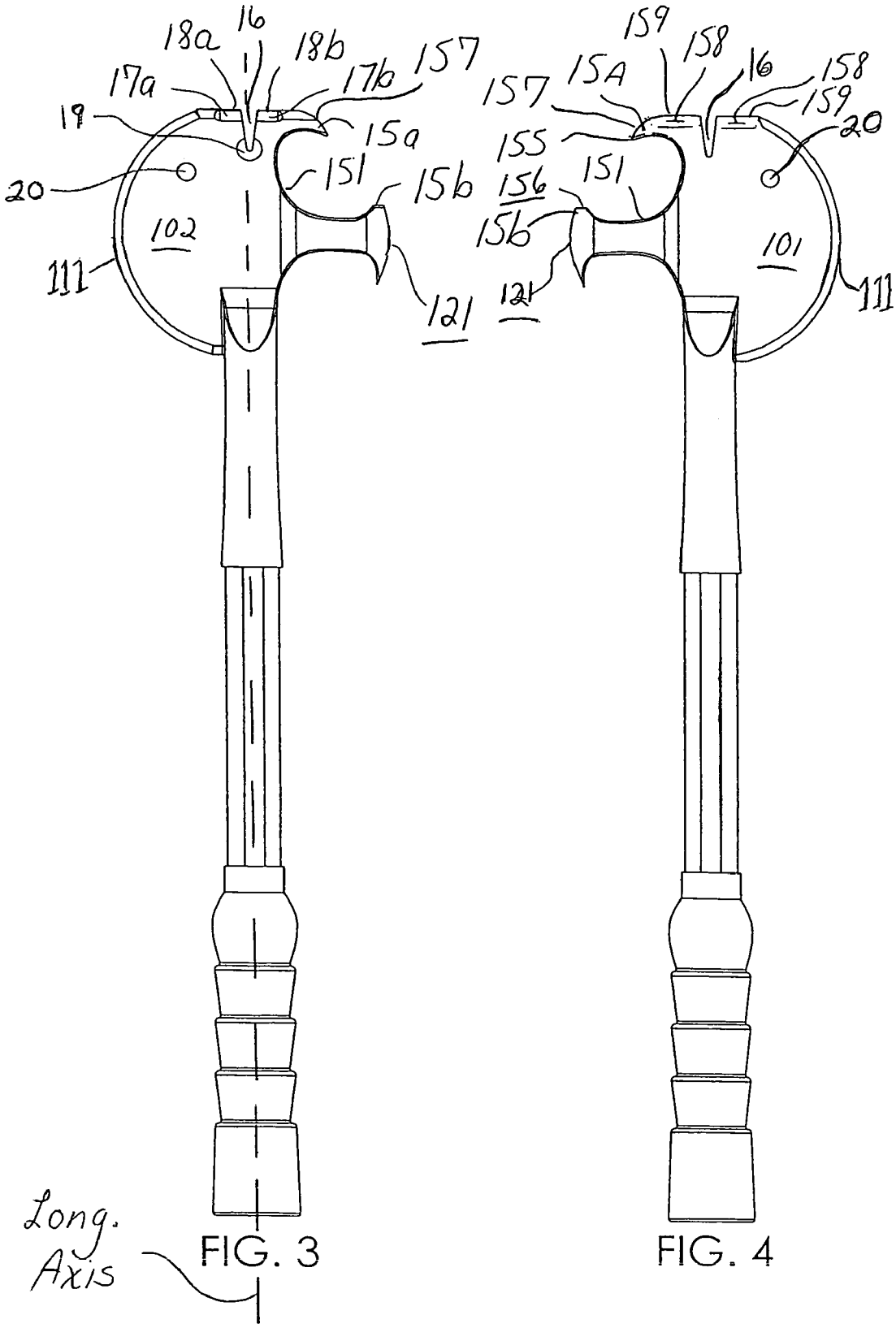
FIG. 3 is a first side view of the embodiment of FIGS. 1 and 2.
FIG. 4 is a second side view of the embodiment of FIGS. 1, 2, and 3.

Referring to the figures, there is shown one, but not the only, embodiment of the invented multi-purpose tool. The preferred embodiment of the invented multi-purpose tool includes an axe-blade ice breaker, a combination hammer/nail remover, a prying tool, and a nail/staple remover, and is designed for use as a lever for moving pallets or other objects. Preferably, all features of the tool are fixed in relationship to each other and to the tool handle—i.e., no moving parts or attachments—which makes the tool more rugged, durable, and effective.

As illustrated by FIGS. 1–6, the preferred embodiment of the invented multi-purpose tool 1 comprises head 10 and handle 30. Handle 30 further comprises shaft 32 and grip 31. Grip 31 preferably is made from a soft, textured non-slip material for a comfortable, secure grip. Head 10 is preferably of unitary, single-piece construction and comprises an axe-type blade 11 for chopping or breaking ice, hammer 12 with notch 14 for removing nails, prying tool 15, and nail and staple handling region 13 with V-shaped notch 16, with slots 17*a* and 17*b* for removing staples and circular notch 19 for removing nails, and hanger hole 20 for easy storage.

Blade 11 preferably comprises an un-honed blade edge 111. For safety reasons, it is preferably not sharp enough to act as a slicing tool, but is sharp enough to chop ice off of an exterior door, such as a truck's cargo door, or to cut into easily-cut materials or dig into granular materials such as snow or dirt. Blade 11 is curved so that, when used to chop ice, only a small portion of blade 11 contacts the target, which tends to minimize the possibility of damage to the vehicle. In the preferred embodiment, blade 11 outer edge 111 curves in an arc that extends in the range of about 160–200 degrees. Most preferably, the blade 11 is a generally semi-circular shape extending from, and substantially located on, one side of the distal end of the tool 1. Preferably, the radius of the semi-circular blade is in the range of 2–4 inches, and most preferably about 2.5 inches. The opposing surfaces of the blade meet at a single junction, blade edge 111, so that the edge 111 is narrow and sharp relative to the main body of the blade but, preferably, is not sharpened to such a fine edge that the blade tends to slice or cut—the edge may be called a "dull" edge that, for example, does not cut a human hand or finger when the hand or finger is rubbed along or transverse to the edge 111.

The curvature of blade 11 makes it easier to insert at least a portion of work blade 11 into the small gap between the bottom of the trailer door and the floor of the trailer. This is useful because the bottom of the trailer door often freezes to the floor. Thus, while necessary, breaking the ice on the outside of the door is generally not sufficient to open the door.

Hammer 12 preferably extends from the distal end of the tool opposite the blade 11. It comprises face 121 for hammering and notch 14 for removing nails, similar to a conventional claw hammer. Although the hammer face 121 is somewhat curved, it generally lies on a plane parallel to the longitudinal axis of the tool and generally perpendicular to the plane of the blade.

The edge 151 of head 10 between the hammer 12 and top of head 10 is roughly C-shaped, and contributes to the formation of prying tool 15, similar to an over-sized bottle-opener. Preferably, the edge 151 is rounded and not sharp. The ends of prying tool 15 comprise hook 15*a* and catch 15*b*, which cooperate to contact an object and allow the user to apply force to it. The outer extremity (tip 155) of hook 15*a* is preferably rounded to prevent the possibility of it puncturing a tire or other object against which the prying force is being applied. Also, the outer extremity (surface 156) of catch 15*b* is also rounded or flattened to prevent the possibility of it puncturing a tire or other object against which the prying force is being applied.

Figure 7:
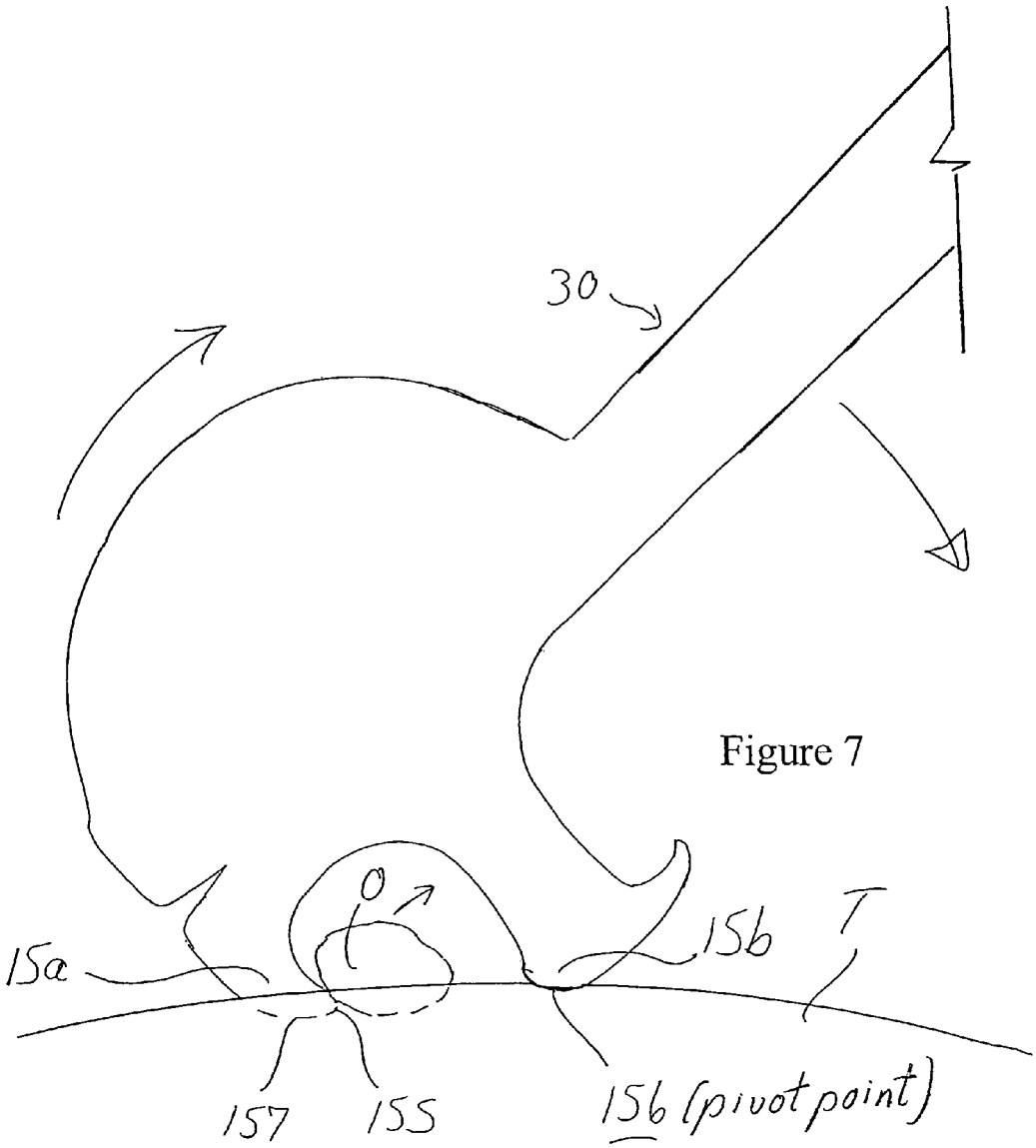
FIG. 7 is a side schematic view of one embodiment of the tool being used to pry an object such as a rock from a tire tread, by pivoting the tool toward the user, wherein a similar operation could be used to move a cross-member of a tire chain assembly to tighten a set of chains.
Figure 8:
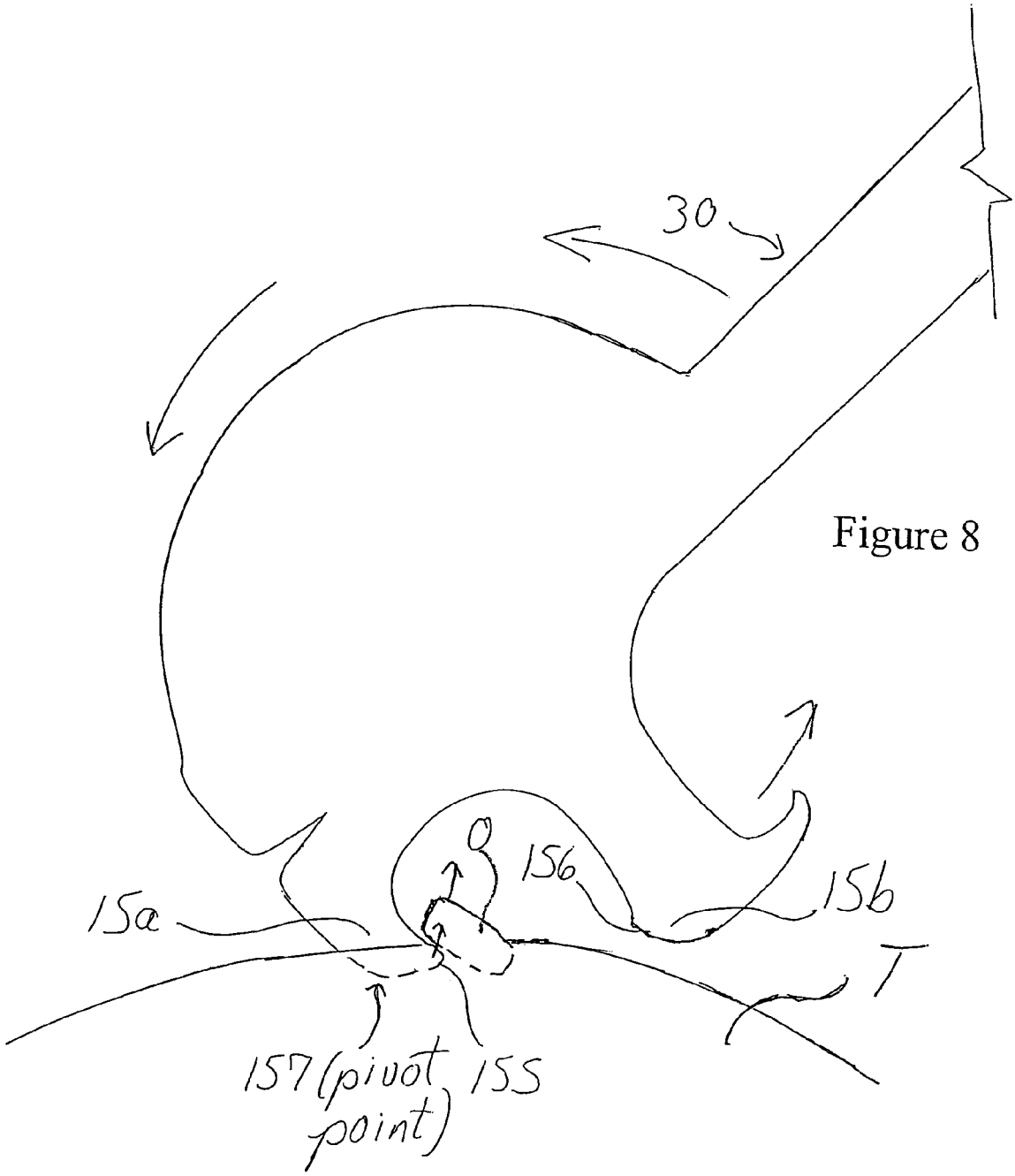
FIG. 8 is a side schematic view of the embodiment of FIG. 7, being pivoted the opposite direction as an alternative way to pry an object.

The trucker or other user may find various ways to use the prying tool 15. Depending on what object(s) the prying tool 15 is being applied to, the clearance for accessing the objects and pivoting/moving the tool, and/or the relative position of the two parts of an object being tightened or pulled, the tool may be pivoted or moved in varying directions. For example, prying tool 15 may be used to remove objects (O in FIG. 7) that have become embedded in tire tread (T in FIG. 7) or to tighten tire chains. Catch 15*b* is placed against the tire surface. Hook 15*a* is placed against and, to the extent possible, under the object, so that the object is caught between the hook 15*a* and the catch 15*b*. Force may then be applied to the object by pushing on the handle toward the tire, which will pivot the tool a short distance with catch 15*b* as the pivot point, causing the hook 15*a* to lift upward and in the direction of the handle proximal end. This will pull the object upwards and slightly proximally to loosen or free it, as shown in FIG. 7. Alternatively, the hook 15*a* may be wedged or placed under the object being pried out of the tire, and the tool may be pivoted on the rounded edge 157 by moving the handle away from the tire (the opposite direction of the previous example). This will tend to swing the tip 155 up and under the object to loosen and free it, as shown in FIG. 8.

Chain tightening may be accomplished by utilizing the same principles. Catch 15*b* is placed against the tire surface, and may be wedged between or against cross-member of the chain assembly. Hook 15*a* is inserted into a chain link or on the side of the cross-member away from the catch. Force is then applied to the chain by pushing on the handle toward the tire to pivot the tool with catch 15*b* as the pivot point, wherein the hook pulls the cross-member upwards and toward the chain cross-members nearer the catch. This, then, increases the overlap between ends of the chain assembly so that the fasteners of the chain assembly may be refastened with the chain assembly tightened around the tire.

The distal extremity of the tool head comprises one side of the tool curving toward a semi-sharp distal edge (159) (shown to best advantage in FIG. 6), creating a rounded surface (158) adjacent the distal edge (159) on which the distal end of the tool may be "rocked". V-shaped notch 16 extends downward from about the center of the distal edge (159) of the head 10. Channels 17*a* and 17*b* extend laterally from near the mouth of V-shaped notch 16. These channels form narrow, semi-sharp lips 18*a* and 18*b*, which are useful for removing staples, nails, and other fasteners. One, or both, of lips 18*a* and 18*b* is forced under the staple or nail, which is greatly facilitated by the rounded, semi-sharp design of the top edge. The fastener may then be pried upward. For some fasteners, such as nails, it may be necessary to repeat this process on different sides or from different angles. This process may also be used to partially remove a nail or fastener to facilitate use of another part of the tool to complete removal—e.g., notch 14 described above. Alternatively, the roughly circular depression 19 at the base of V-shaped notch 16 may be used for removing nails or other fasteners. Assuming the head of the nail is larger than the bottom of circular depression 19, the tool is worked under the nail so that the head of the nail is within circular depression 19. The nail is then pried up and out. V-shaped notch 16 may also be used to grip and twist or break wire, such as barbed wire. Thus, farmers and ranchers will also find the invented multi-purpose tool useful for building and repairing wire fences. Thus, it may be said that multiple tools or surfaces for twisting, grasping, pulling, or prying under staples, are positioned on or extending into the head edge that is transverse to the axis of the tool.

Figure 5:
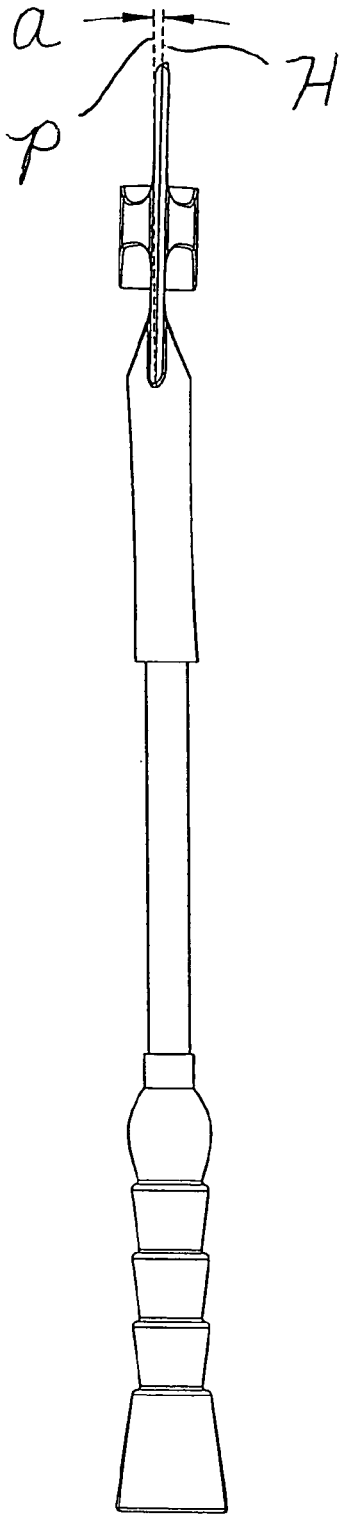
FIG. 5 is a front view of the embodiment of FIGS. 1–4 (from the left as defined by the viewer's perspective looking at the first side as in FIG. 3).
Figure 6:
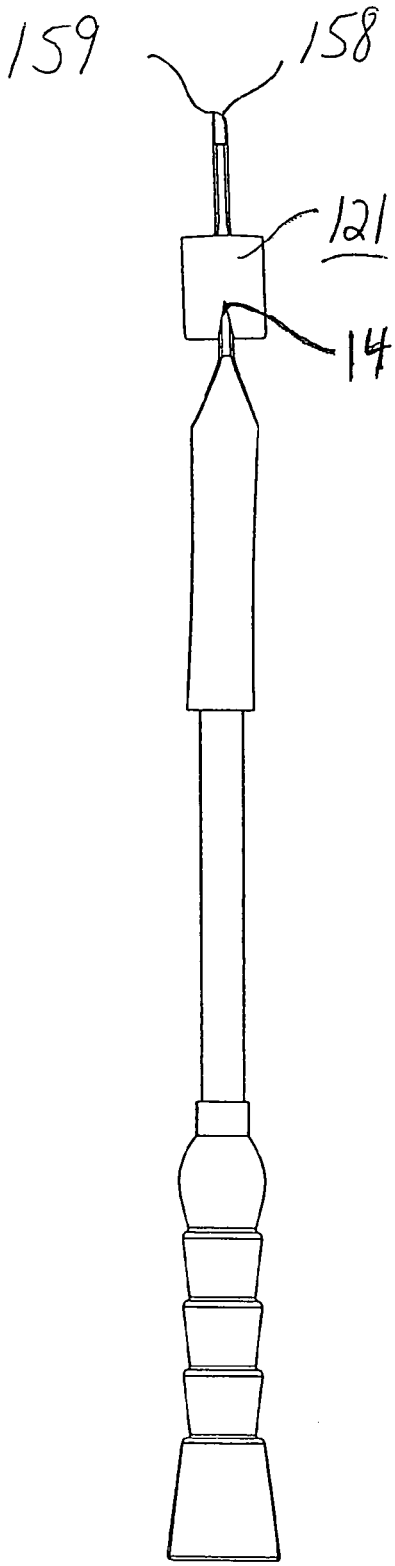
FIG. 6 is a back view of the embodiment of FIGS. 1–5 (from the right as defined by the viewer's perspective looking at the first side as in FIG. 3).

As shown in FIGS. 5 and 6, the plane of head 10 is somewhat out of alignment with handle 30, so that plane H of the head is not parallel and not co-planar with the plane P passing through the handle axis. Angle a between head 10 and handle 30 is preferably in the range of about 2 degrees to 5 degrees, but may less preferably be in the range of 2 degrees to 10 degrees. When the top of head 10 is properly placed under an object, such as a palette, for use as a pry bar, angle a elevates handle 30 a slight distance above the ground or supporting surface. This makes it easier to insert the top of head 10 under the object and to grasp the handle. It also gives the user some room to push down on handle 30, putting upward force on the object. This feature is particularly useful for moving loaded palettes by lifting a portion of the palette, thereby reducing frictional resistance to sliding the palette. Also, the curvature of blade 11 helps the user work it under an object when the invented tool is used as a pry bar. Further, the top of head 11 is rounded up to the point, making it easier for the user to work it under an object when the invented tool is used as a pry bar.

As described in the foregoing description, the invented tool effectively addresses the difficult tasks most frequently faced by commercial truck drivers. The invented tool is rugged, durable, and effective. In addition, it is light and compact making it easy to use and convenient to store in the limited space available in a commercial cargo truck.

Although this invention has been described above with reference to particular means, materials, and embodiments, it is to be understood that the invention is not limited to these disclosed particulars, but extends instead to all equivalents within the scope of the following claims.

I claim:

1. A multipurpose tool comprising:
a single-piece head;
a handle connected to the head;
wherein the head comprises:
a blade comprising an un-honed blade edge, and wherein an outer edge of the blade extends generally in a semi-circle with an arc between 160 degrees and 200 degrees;
a hammer with a first notch;
a prying tool; and
a second notch;
wherein the head, blade, first notch, prying tool, and second notch generally lie in a first plane;
wherein the blade extends from a first side of the head, the second notch extends from a second side of the head, and the hammer extends from a third side of the head;
wherein the first side of the head and the third side of the head are on opposite sides of the handle and are perpendicular to the handle; and
wherein the second side of the head is opposite from a fourth side of the head where the head is attached to the handle.

2. The multipurpose tool of claim 1 wherein the outer edge of the blade has a radius of curvature between 2 inches and 4 inches.

3. The multipurpose tool of claim 1 wherein the outer edge of the blade has a radius of curvature of about 2.5 inches.

4. The multipurpose tool of claim 1 wherein the hammer further comprises a face which lies in a second plane which is perpendicular to the first plane.

5. The multipurpose tool of claim 4 wherein the first notch extends from a bottom end of the face and is adapted to remove nails.

6. The multipurpose tool of claim 1 wherein the prying tool comprises a C-shaped recess within the head between the second notch and the hammer.

7. The multipurpose tool of claim 6 wherein a first end and a second end of the C-shaped recess are rounded.

8. The multipurpose tool of claim 1 further comprising a rounded depression at a base of the second notch.

9. The multipurpose tool of claim 1 further comprising two channels extending laterally from a mouth of the second notch.

10. A multipurpose tool comprising:
a single-piece head;
a handle connected to the head;
wherein the head comprises:
a blade
a hammer with a first notch;
a prying tool; and
a second notch;
wherein the head, blade, first notch, prying tool, and second notch generally lie in a first plane;
wherein the blade extends from a first side of the head, the second notch extends from a second side of the head, and the hammer extends from a third side of the head;
wherein the first side of the head and the third side of the head are on opposite sides of the handle and are perpendicular to the handle; and
wherein the second side of the head is opposite from a fourth side of the head where the head is attached to the handle;
wherein the handle lies in a third plane which is not parallel to the first plane.

11. The multipurpose tool of claim 10 wherein an angle between the first plane and the third plane is between 2 degrees and 10 degrees.

12. The multipurpose tool of claim 10 wherein an angle between the first plane and the third plane is between 2 degrees and 5 degrees.

13. A multipurpose tool comprising:
a head comprising a blade, a hammer extending opposite from the blade, a notch in a distal extremity of the blade in between the blade and the hammer, and a c-shaped edge between the notch and the hammer having a first end and a second end, the c-shaped edge forming a recess adapted to receive an object being pried by the first; and
the multipurpose tool further comprising an elongated handle extending from a proximal extremity of the blade between the blade and the hammer, the head being on a plane between two degrees and ten degrees from a longitudinal axis of the handle.

14. The multipurpose tool of claim 13, wherein the first end is a tip adjacent to and extending perpendicularly to the notch.

15. The multipurpose tool of claim 14 wherein the second end is a portion of the hammer.

16. A multipurpose tool comprising:
ahead;
a handle connected to the head;
wherein the head comprises:
a blade comprising an un-honed blade edge which extends generally in a semi-circle with an arc between 160 degrees and 200 degrees and has a radius of curvature between 2 inches and 4 inches;

a hammer with a face which lies in a second plane which is perpendicular to a first plane of the head and a first notch which extends from a bottom end of the face and is adapted to remove nails;

a prying tool comprising a C-shaped recess within the head between the second notch and the hammer, wherein a first end and a second end of the C-shaped recess are rounded; and a second notch comprising two channels extending laterally from a mouth of the second notch and a rounded depression at a base of the second notch;

wherein the head, blade, first notch, prying tool, and second notch generally lie in the first plane;

wherein the blade extends from a first side of the head, the second notch extends from a second side of the head, and the hammer extends from a third side of the head;

wherein the first side of the head and the second side of the head are on opposite sides of the handle and are perpendicular to the handle;

wherein the second side of the head is opposite from a fourth side of the head where the head is attached to the handle wherein the handle lies in a third plane which has an angle between 2 degrees and 10 degrees from the first plane.

* * * * *